US006280157B1

(12) United States Patent
Cooper

(10) Patent No.: US 6,280,157 B1
(45) Date of Patent: Aug. 28, 2001

(54) SEALLESS INTEGRAL-MOTOR PUMP WITH REGENERATIVE IMPELLER DISK

(75) Inventor: Paul Cooper, Titusville, NJ (US)

(73) Assignee: Flowserve Management Company, Irving, TX (US)

( * ) Notice: Subject to any disclaimer, the term of this patent is extended or adjusted under 35 U.S.C. 154(b) by 0 days.

(21) Appl. No.: 09/342,588

(22) Filed: Jun. 29, 1999

(51) Int. Cl.[7] ..... F04B 17/00
(52) U.S. Cl. ..... 417/423.7
(58) Field of Search ..... 417/423.1, 423.11, 417/423.2, 423.5, 423.7

(56) References Cited

U.S. PATENT DOCUMENTS

| | | | | |
|---|---|---|---|---|
| 3,963,371 | | 6/1976 | Sieghartner | 415/199 T |
| 4,678,395 | | 7/1987 | Schweinfurter | 415/53 T |
| 5,193,977 | * | 3/1993 | Dame | 415/206 |
| 5,195,877 | | 3/1993 | Kletschka | 417/356 |
| 5,299,908 | | 4/1994 | Robbie | 415/55.1 |
| 5,407,318 | | 4/1995 | Ito et al. | 415/55.1 |
| 5,498,124 | | 3/1996 | Ito et al. | 415/55.1 |
| 5,513,950 | | 5/1996 | Yu | 415/55.1 |
| 5,527,149 | | 6/1996 | Moss et al. | 415/55.1 |
| 5,702,229 | | 12/1997 | Moss et al. | 415/55.4 |
| 5,762,469 | | 6/1998 | Yu | 415/55.1 |
| 6,068,454 | * | 5/2000 | Gaston | 417/356 |

* cited by examiner

*Primary Examiner*—Timothy S. Thorpe
*Assistant Examiner*—William H Rodriguez
(74) *Attorney, Agent, or Firm*—Killworth, Gottman, Hagan & Schaeff, L.L.P

(57) ABSTRACT

A fluid pump comprises a housing having a fluid passage extending circumferentially between at least one fluid inlet port and at least one fluid discharge port. The ports are separated by an interruption of the fluid passage located upstream of the inlet and downstream of the discharge. At least one regenerative rotor disk is rotatably supported within the housing and having a plurality of radially oriented impeller vanes situated about the periphery thereof within the fluid passage and also having a plurality of permanent magnets embedded therein in a circular locus about an axis of rotation of the disk, the magnets being sealed against pumped fluid. At least one set of motor windings is encased in at least one wall of the housing axially adjacent the permanent magnets in the regenerative rotor disk and also sealed against pumped fluid. Means is provided for controlling a flow of electricity through the motor windings to rotatably drive the rotor disk. A shaft may be supported in the housing in product lubricated bearings or in magnetic bearings, or alternatively, the rotor disk may be rotatably supported on a stationary shaft on product lubricated bearings or on magnetic bearings. It may also be supported on such bearings without a shaft.

30 Claims, 6 Drawing Sheets

FIG. 1a
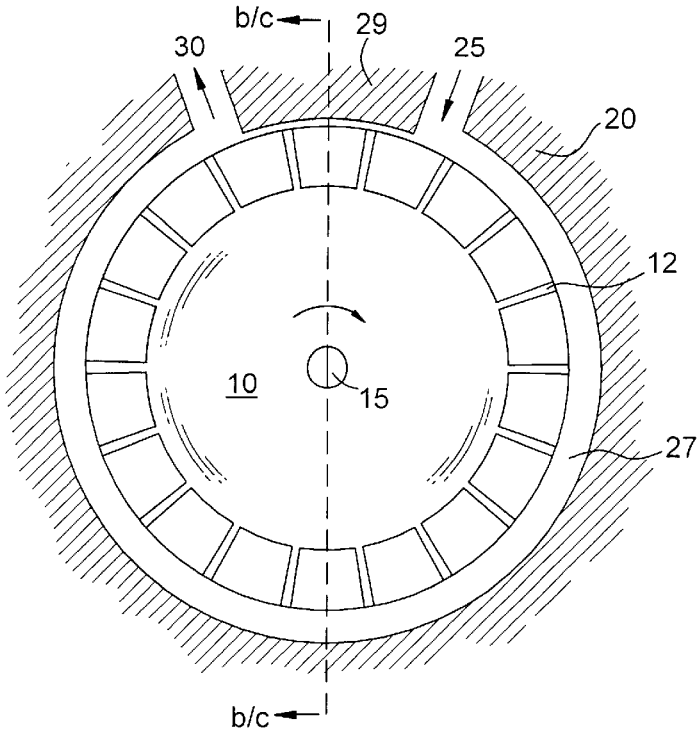
FIG. 1b
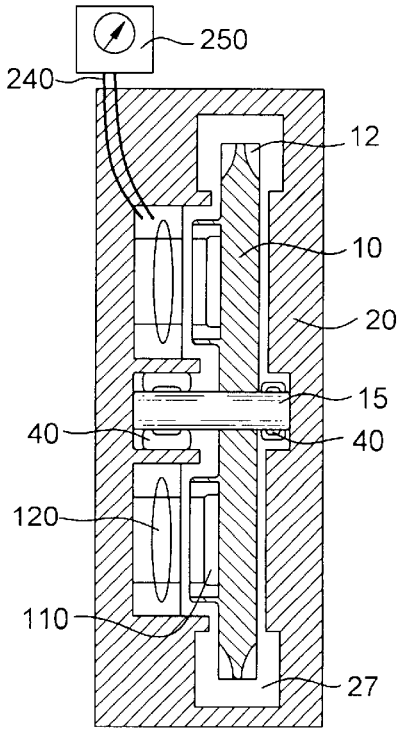
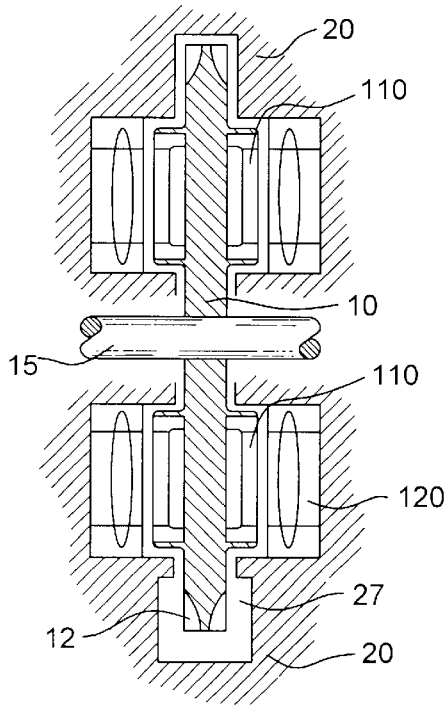
FIG. 1c

SEALLESS INTEGRAL-MOTOR PUMP WITH REGENERATIVE IMPELLER DISK

BACKGROUND OF THE INVENTION

This invention relates generally to fluid pumps and more particularly to high-pressure-rise, low-flow-rate charging pumps for providing make-up fluids to closed high-pressure systems.

For applications such as charging pumps for supplying make-up fluid to closed high-pressure systems, it is necessary to employ pumps capable of supplying relatively low-flow-rate fluid at high pressure. It is desirable for such pumps to be highly leak resistant because of the types of fluids and the pressures involved. The most favored method of providing such leak resistance is by employment of sealless pumps. Sealless pumps often incorporate motors located inside the pump case, so there are no shaft pass-throughs to seal against leakage of the pumped fluid.

Current high-pressure-rise, low-flow-rate pumps are typically positive-displacement reciprocating pumps which are highly efficient, but, because of the necessary rotary-to-reciprocating motion converters, are large and difficult to configure as sealless pumps. Thus, when environmental considerations are important, the sealless feature becomes more important and positive-displacement reciprocating pumps become less practical due to the difficulty of adapting a reciprocating drive to a sealless pumpage-tolerant coupling mechanism. This is a serious drawback since many sealless applications rely on product lubricated bearings to reduce friction and wear in the pump equipment.

Although rotodynamic pumps are less efficient than are positive displacement pumps, they have the advantage of being much more amenable to sealless designs than are reciprocating positive displacement designs. Rotodynamic pumps are also more easily configured as sealless multi-stage machines, which permits their use in very high pressure applications. Thus, reciprocating positive displacement pumps, although more efficient than single-stage rotodynamic pumps, lose some of that efficiency advantage when multi-stage sealless features are employed.

The foregoing illustrates limitations known to exist in present low-flow-rate, high-pressure-rise pumps. Thus, it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a fluid pump comprising; a housing and having at least one fluid passage extending circumferentially between at least one fluid inlet port and at least one fluid discharge port, said ports being separated by an interruption of said fluid passage located upstream of each said inlet and downstream of each said discharge; at least one rotatable rotatable rotor disk rotatably supported within said housing and having a plurality of substantially radially oriented impeller vanes situated about the periphery thereof within said circumferentially extending fluid passage, the disk also having a plurality of permanent magnets embedded therein in a circular locus about an axis rotation of said disk, said magnets being sealed against pumped fluid; at least one set of motor windings encased in at least one wall of said housing axially adjacent the permanent magnets in said at least one regenerative rotor disk and also sealed against pumped fluid; and means for controlling a flow of electricity through said motor windings to rotatably drive said rotor disk.

The foregoing and other aspects will become apparent from the following detailed description of the invention when considered in conjunction with the accompanying drawings.

BRIEF DESCRIPTION OF THE DRAWINGS

FIG. 1*a* is a fragmentary schematic radial sectional view of a single stage of a single pass regenerative pump;

FIG. 1*b* is a schematic axial sectional view, along line b—b of FIG. 1*a,* of a single stage sealless axially magnetically unbalanced embodiment of a single-pass regenerative pump;

FIG. 1*c* is a fragmentary schematic axial sectional view, along line c—c of FIG. 1*a,* of a single stage of an axially magnetically balanced embodiment of a sealless single-pass regenerative pump of the invention;

DETAILED DESCRIPTION

Figure 1D:
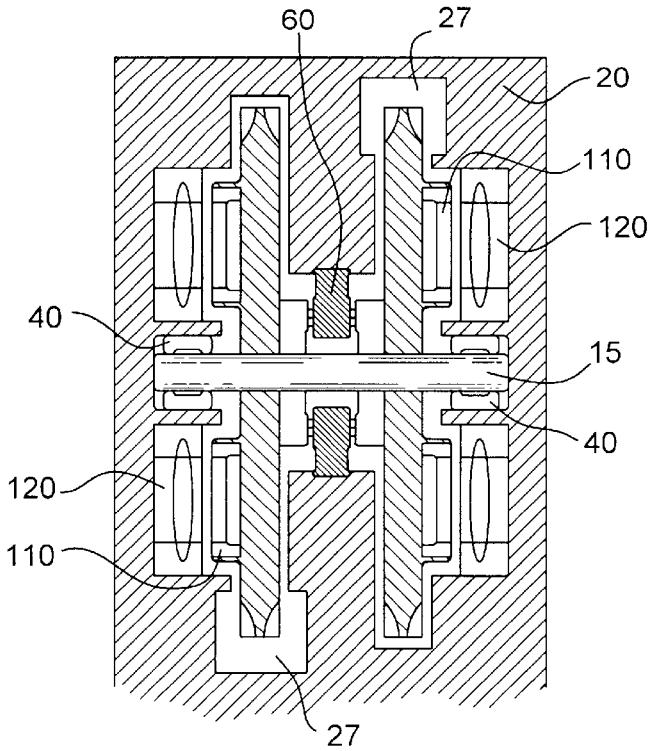
FIG. 1*d* is a schematic axial sectional view of a sealless two-stage, single-pass regenerative pump according to the invention.

The figures show several aspects and embodiments of the integral-motor regenerative rotor-disk of the invention. These include many features which are common to several of the views shown and are assigned the same numerical designators. Where a feature includes a significant deviation, it is numbered differently from its other illustrations.

FIG. 1*a* shows a partially sectional view of a single stage of a single pass regenerative pump. The pump has a housing 20 with a single inlet port 25 and a single discharge port 30 which are connected by a fluid passage 27 extending circumferentially between the inlet and outlet ports. An interruption 29 of the fluid passage separates the upstream edge of the inlet port 25 and the downstream edge of the discharge port 30. Thus, fluid entering the inlet port 25 is caught by impeller vanes 12 on the rotor 10, which is rotating on a shaft 15 supported in the axial endwalls of the housing 20, and driven along the fluid passage 27 to the discharge port 30. The interruption 29 of the passage guides the fluid into the discharge port. The ports 25, 30 are shown with corners only as a simplified representation, but are normally provided with radii appropriate to the fluid being pumped in accordance with well known porting practice. The vanes 12 are shown as straight and radial for the sake of illustrative simplicity. In fact, they may be straight with an inclination angle to the axis or the tangent of the rotor disk 10, and/or they may be curved in the axial and/or radial direction. The specific application determines the vane configuration. Axially opposite vanes of the disk may be offset from each other or may be axially aligned. The single-pass rotors shown are each radially hydrodynamically unbalanced due to the pressure rise between the inlet port 25 and the discharge port 30 in the fluid passage 27 which results in a resultant radial hydrodynamic force approximately opposite to the discharge port 30. In multistage pumps, these hydrodynamic forces may be offset by placement of the inlet and discharge ports diametrically opposite in two stage pumps or by radially distributing them about the housings to balance the hydrodynamic forces in pumps exceeding two stages.

Figure 5:
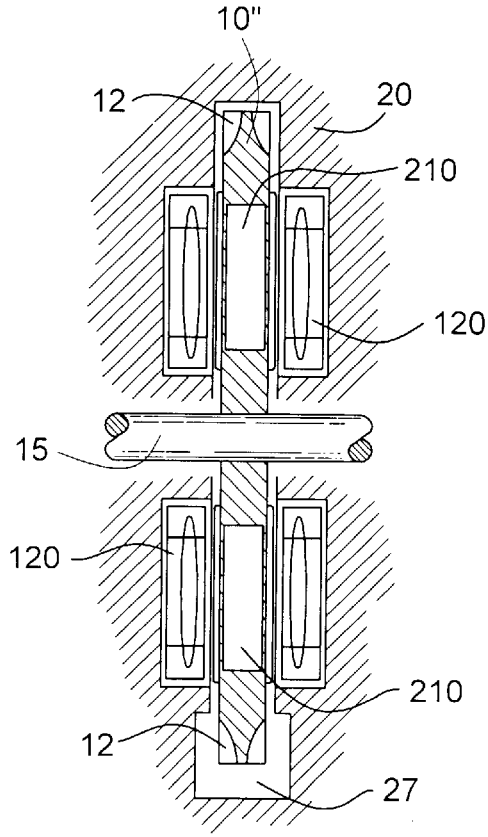
FIG. 5 is a fragmentary schematic view of a single stage of another embodiment, as in FIG. 1*c,* of the axially magnetically balanced sealless integral motor regenerative rotor disk pump of the invention.

FIGS. 1*b* and 1*c*, are views along line b/c—b/c of FIG. 1*a* and show the integral motor features of the regenerative rotor pump. A brushless DC motor is provided by means of the embedded circular array of permanent magnets 110 in the rotor disk 10 in conjunction with a stator comprising the motor windings 120 encased in the housing 20. The resulting magnetic coupling between the permanent magnets 110 and motor windings 120 provides the brushless motor drive desired for the sealless pump. FIG. 1*b* illustrates an axially magnetically unbalanced rotor disk 10 with embedded permanent magnets 110 on one face adjacent to motor windings 120 embedded in the housing 20 and powered by electric current introduced through electric leads 240 which are fed through the stationary housing 20 to a motor controller 250. The magnets 110 and motor windings 120 are sealed against contact with the pumped fluid. The shaft 15 on which the disk 10 is mounted is supported in the housing 20 in bearings 40 which may be of journal or antifriction types. The fluid passage 27 is shown with a rectangular cross-section, again only as a simplified representation, but will preferably be provided with a cross-sectional geometry compatible with the regenerative flow profile of the pumped fluid caused by the pumping action of the impeller vanes 12. The fragmentary view in FIG. 1*c* is of a single stage of an axially magnetically balanced integral motor regenerative rotor disk 10'. In this design, permanent magnets 110 are embedded in both faces of the rotor disk 10 and are rotatably driven by electromagnetic forces from the motor windings 120 in the walls of the housing 20 adjacent to the web of the rotor disk. An alternative embodiment of this axially magnetically balanced pump is shown in FIG. 5, in which a single set of permanent magnets 210 are embedded in the rotor 10" to react to motor windings 120 in both axially adjacent housing walls. This has the advantage of reducing the mass and volume and smoothing the radial profile of the web of the rotor disk 10" relative to that of disk 10' in FIG. 1*c*, thereby simplifying design and fabrication of the rotor disk 10" and the axially adjacent walls of the housing 20.

Figure 2A:
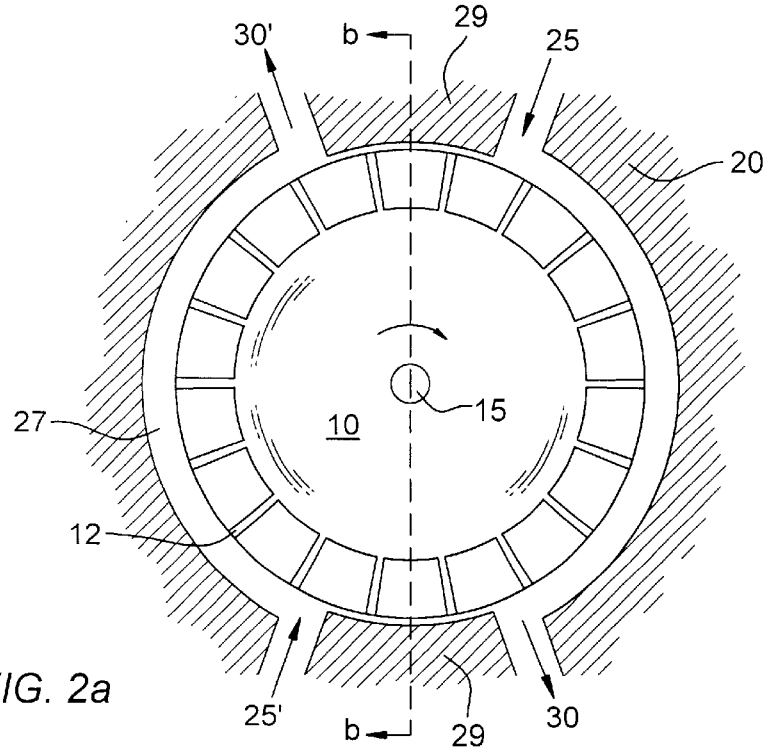
FIG. 2*a* is a fragmentary schematic radial sectional view of a sealless two-pass regenerative pump.
Figure 2B:
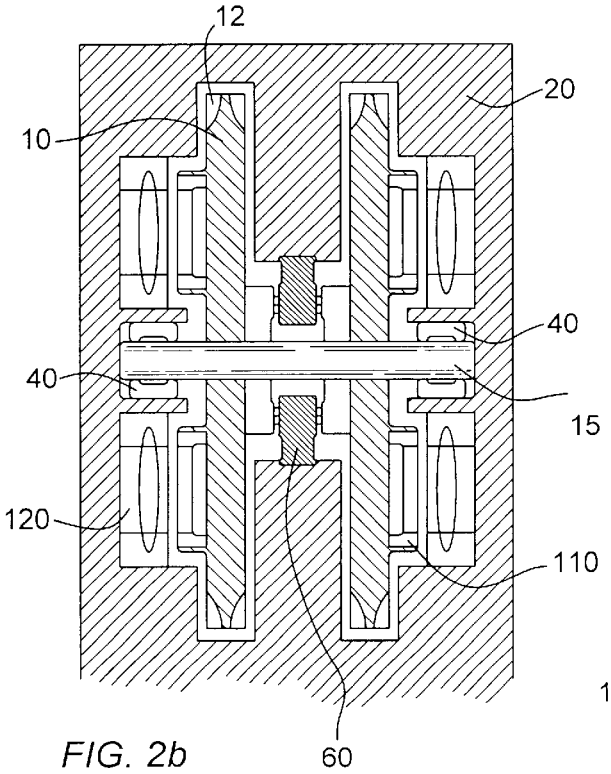
FIG. 2*b* is a schematic axial section, along line b—b of FIG. 2*a,* of a sealless two-stage, two-pass regenerative pump according to the invention.
Figure 3A:
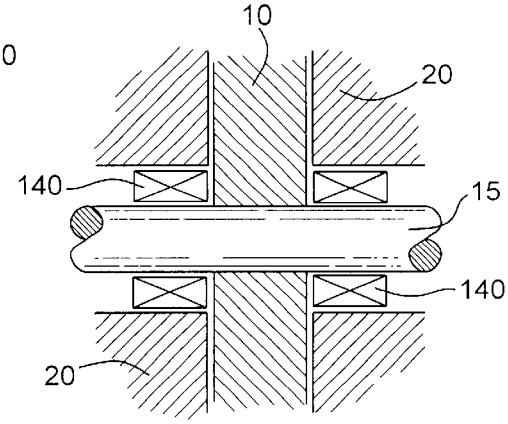
FIG. 3*a* is a fragmentary axial sectional view of a rotor disk mounted on a shaft supported in product-lubricated bearings of a sealless pump.
Figure 3B:
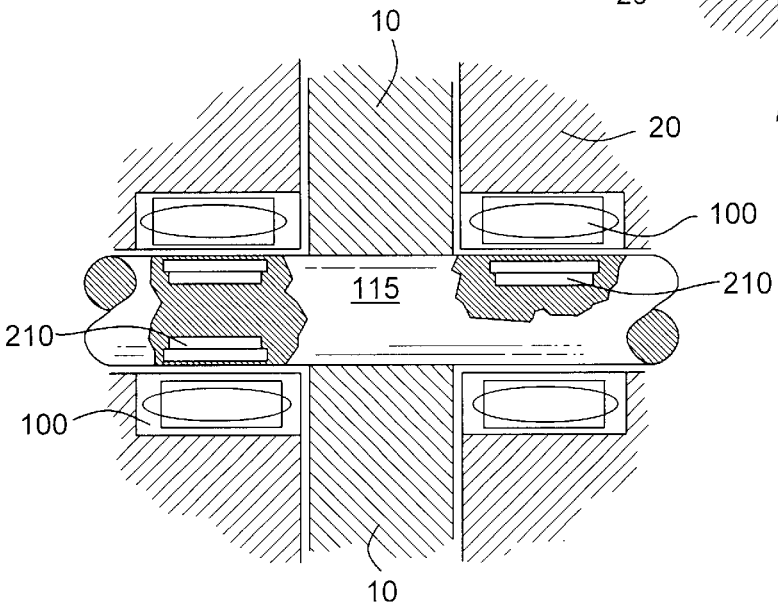
FIG. 3*b* is a view, as in FIG. 3*a,* of a shaft supported in magnetic bearings in a sealless pump.
Figure 4A:
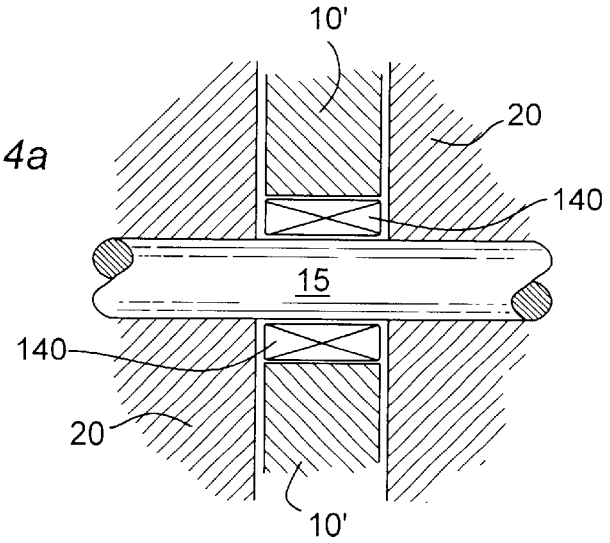
FIG. 4*a* is a fragmentary axial sectional view of a rotor disk supported on product-lubricated bearings on a stationary shaft of a sealless pump.
Figure 4B:
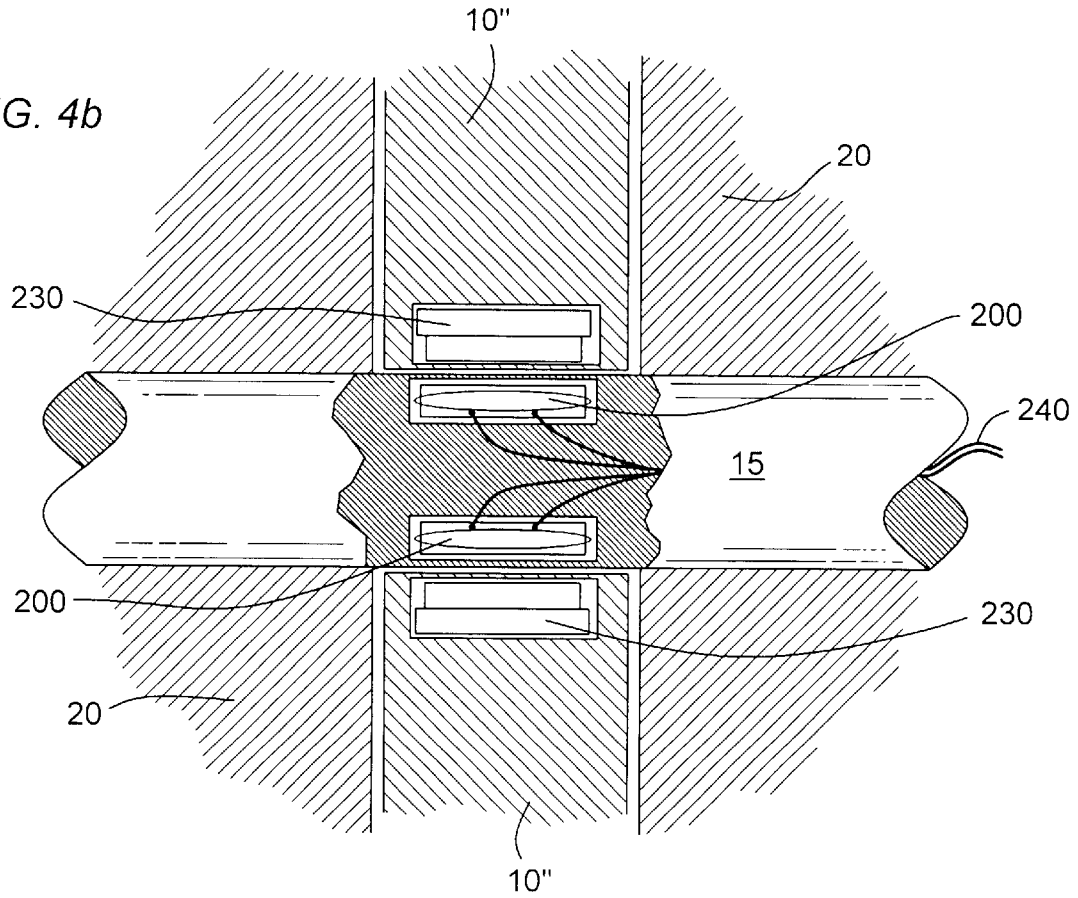
FIG. 4*b* is a view, as in FIG. 4*a,* of a rotor supported on magnetic bearings.

FIGS. 1*d* and 2*b* show two stage sealless regenerative pumps, one-pass and two-pass versions, respectively. It should be noted that the housing 20 in all Figs. is shown schematically without seams. In reality, the housing may be comprised of a plurality of torroidal disks bounding a plurality of rotor disks with solid endwalls enclosing the disks. Such housing assembly detail is not germane to the invention and is thus not illustrated. In both cases, the pumps are axially magnetically balanced due to the oppositely situated motor windings 120 in the endwalls of the housing 20 acting on the permanent magnets 110 embedded in the faces of the disks 10 adjacent to the endwalls in which the windings are encased. Of course, this design can accommodate many more than two stages, in which case axial balancing would only require equal numbers of opposed motor winding sets. In both FIGS. 1*d* and 2*b*, the housings 20 support the shafts 15 in bearings 40. Regenerative rotor disks 10 with substantially radially oriented impeller vanes 12 are mounted on shafts 15 and rotate within fluid passages 27 (not visible in FIG. 2*b*) between inlet ports 25 and discharge ports 30, separated by fluid passage interruptions 29. Permanent magnets 110 are embedded in the rotor disks 10 and are electromagnetically driven by the motor windings 120 in the endwalls of the housing 20.

Although the pumps shown in these FIGS. 1*d* and 2*b* are axially balanced, thrust bearing assemblies 60 are provided between the stages to prevent the rotors rubbing the housing walls in case of mechanical or hydraulic axial shocks. In some service, thrust bearings may not be needed; therefore, when included, they do not contact the rotors during normal operation except when an axial upset is introduced to the system. The thrust bearing assemblies 60 and the radial bearings 40 may be product (or pumpage) lubricated journals or anti-friction bearings, or they may be magnetic bearings. The particular type is determined by service and performance factors.

The bearings in FIGS. 3*a*, 3*b*, 4*a*, and 4*b* are illustrated as radial bearings. These may be journals or anti-friction radial mechanical bearings 140 (FIGS. 3*a* and 4*a*) which may be product (or pumpage) lubricated and cooled. Alternatively, they may be magnetic bearings comprised of permanent magnets 210, 230 embedded in the rotating member 10', 10", 15, 115 and electromagnets (or, optionally, permanent magnets) opposedly embedded in the stationary member 15", 20 to provide the required magnetic support. In the case where electromagnets are provided in the stationary member, electric leads 240 are fed out to an outside power source. These radial bearing systems provide radial support to the rotating member(s) within or on the stationary member(s).

The single-stage rotor 10" shown in FIG. 5 is axially magnetically balanced by magnetic forces between the motor windings 120 in the housing 20 and the permanent magnets 210 in the rotor. Only a single stage is illustrated, but any number of magnetically balanced stages may be mounted on the shaft 15 in added sections of the housing 20. The rotor 10" has the same impeller blades 12, and the housing has the same fluid passage as discussed above, but here each stage is axially magnetically balanced, independently of any other stages.

Figure 6A:
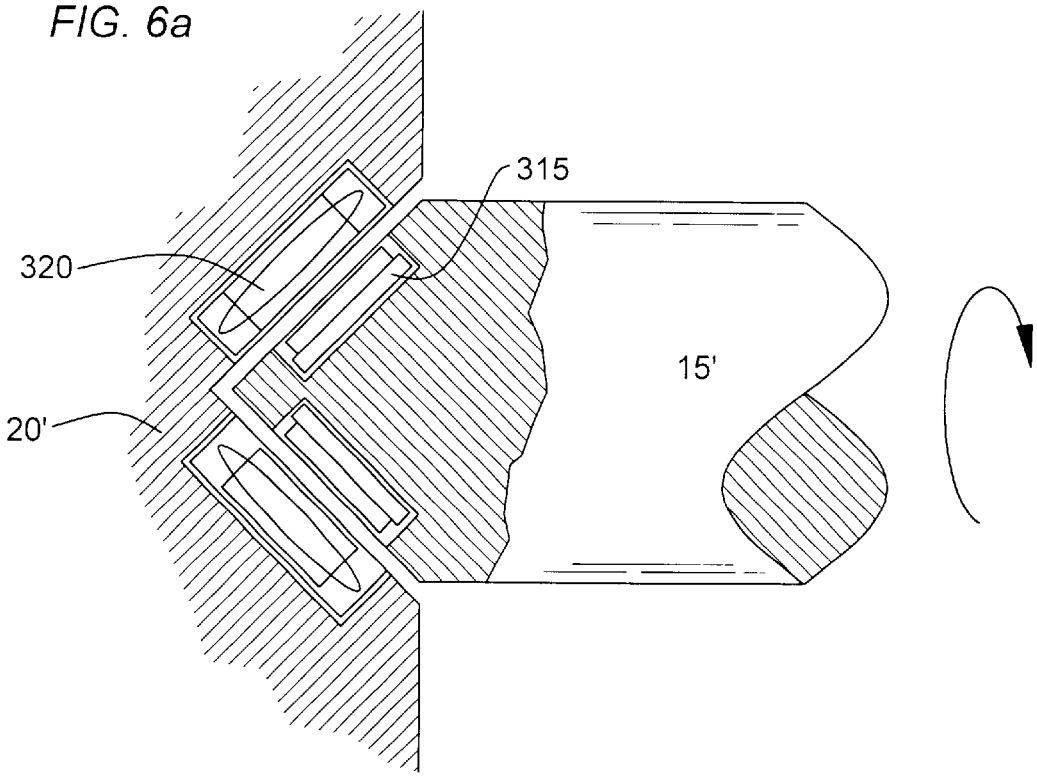
FIGS. 6*a* and 6*b* are fragmentary sectional illustrations of the shaft and the regenerative rotor disk, respectively, rotatably supported on conical magnetic bearings in the housing.
Figure 6B:
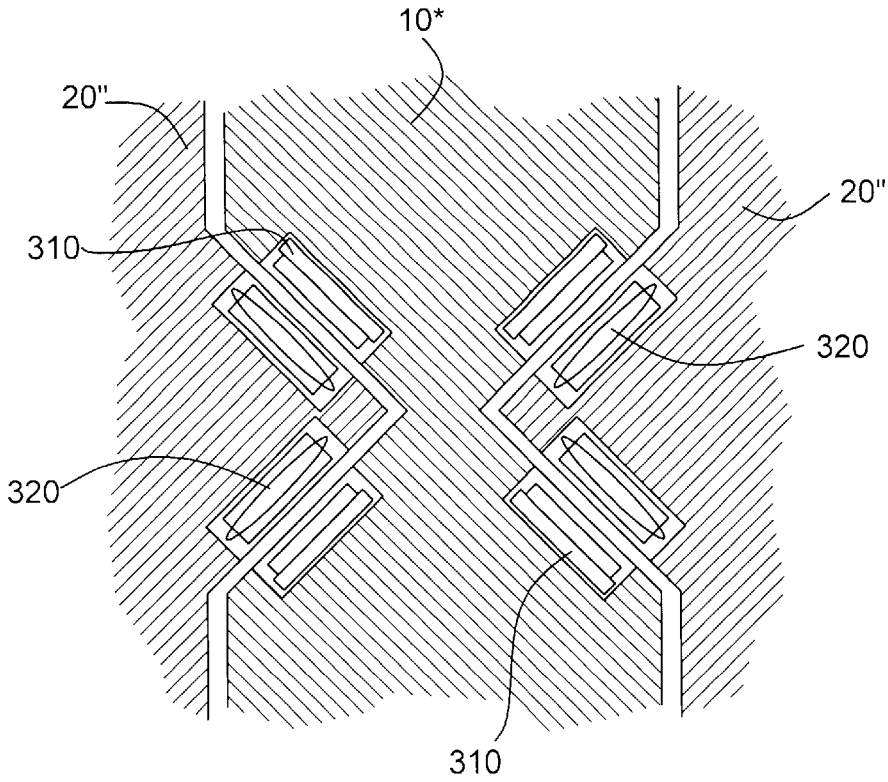

Clearly, conical bearings, of any type including product lubricated journals, anti-friction bearings, or magnetic bearings, which provide both radial and axial support may also be employed. FIGS. 6*a* and 6*b* show one type of conical magnetic bearings for use with a rotor made from non-magnetizable material such as aluminum, bronze, polymers, etc. In FIG. 6*a*, the rotatable shaft 15' is supported on magnetic bearings comprising permanent magnets 315 in the shaft and electromagnets 320 in the housing wall 20'. The force field created between the magnets 315, 320 levitate the shaft within the conical cavity of the housing wall 20' and provide a friction-free axial and radial bearing support for the shaft 15'. When the magnetic forces are repulsive instead of attractive, permanent magnets could be used in both the shaft 15' and the wall 20'. Otherwise the electromagnets are needed to fine tune the position of the shaft, because they allow adjustment of the levitating forces. FIG. 6*b* shows a rotor supported on conical bearings of the housing 20" with no shaft. In this case, the rotating member (rotor 10*), being of non-magnetic material as in FIG. 6*a,* has permanent magnets 310 arrayed about opposed conic recesses radially centered on the rotor disk. For purposes of magnetic bearing suspension, it is only necessary that the rotating member be made of a magnetizable material. In such cases, the electromagnets and, if used, permanent magnets act directly upon the magnetizable rotating member to create the magnetic suspension. When made from a non-magnetizable material, the rotating member may alternatively be provided with a magnetizable susceptor at the appropriate location. Whether to locate the projections on the housing or on the disk is determined by manufacturing considerations, since the magnetic bearings are equally effective in both cases. In the example illustrated in FIG. 6*b,* electromagnets 320 or permanent magnets 310 are arrayed about conic axial projections of the housing 20". The force field created by these magnets provides magnetic combined radial and axial suspension to the rotor disk 10* without use of a shaft. The projections and recesses above have been described as conical, but may be of any form, such as hemispheric, cylindrical, or combinations of forms.

Figure 6C:
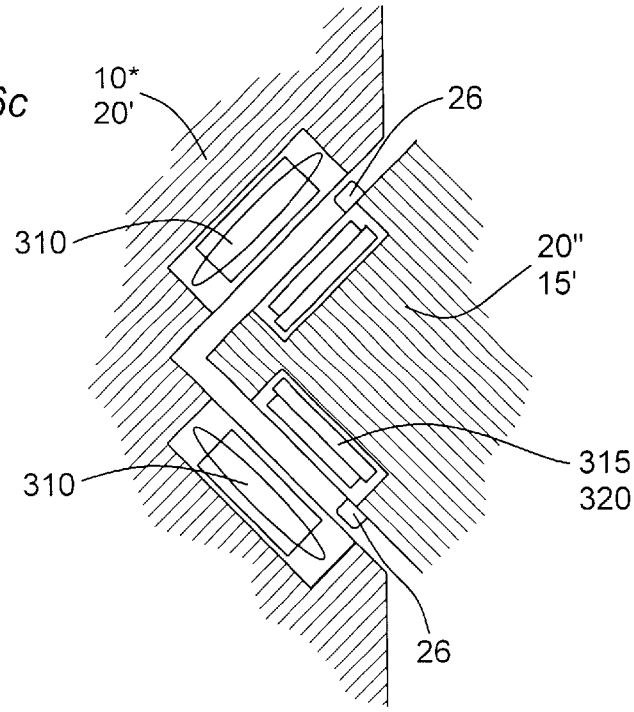
FIG. 6*c* is fragmentary sectional illustration of a recess in the housing for supporting either the shaft or the rotor disk on magnetic bearings.

In cases where magnetic bearings are used, it is preferred to provide small stand-off journals or auxiliary bearings 26, as in FIG. 6*c,* to approximately center the rotor 10* and/or shaft 15' in the housing 20", 20'. This protects the magnets in the absence of electric power, including the permanent magnets which may also be those used for power transmission. In this case, the permanent magnets 310, 315 are embedded in the rotatable rotor disk 10* or shaft 15', while the electromagnets 320 are preferably provided on the conic projection of the housing 20" or the shaft 15'. The stand-off journals 26 may be of any suitable bearing material for service during start-up or transient operating conditions and are usually not in contact with the rotating member during steady-state operation of the fluid pump. When the rotor disk is made from, or has a susceptor feature made from a magnetizable material, permanent magnets in the disk may not be required for the magnetic suspension. However, they are still needed for the brushless DC integral-motor rotor feature previously described. Finally, a combined rotor drive and magnetic bearing suspension may be achieved by locating at least some of the permanent magnets in a radial position in the rotor such that they can respond to both the electromagnetic fields of the motor windings and the magnetic force field of the suspension bearing electromagnets. In all cases, permanent magnets, if needed, are embedded in the rotary member; and the motor windings and the electromagnets are embedded in the stationary member, so that no rotating electrical contact is needed.

This invention provides the advantages of an integral-motor pump of a rotodynamic type which is readily amenable to sealless design, multistaging, and operation with less than all stages running. By suitably manifolding between discharge ports of preceding phases or stages and inlet ports of succeeding phases or stages, operating total pressure-rise can be accurately varied as required. For example, operation of multiple stages in series would provide a substantially additive final discharge pressure; while operation of the same pump stages in parallel would provide substantially additive final discharge volume. When the rotors are individually rotatably supported on a stationary shaft or when a shaftless rotor design is incorporated, as described above, the pump can be operated with one, some, or all stages of a multistage configuration running. This, along with the manifolding above, permits previously unattainable versatility of operation.

The regenerative impeller-disk pump described herein has the advantage of being readily multistaged due to the fact that the suction and discharge ports are at the periphery of the pumping chamber. Thus, fluid passing from one stage or one phase to the next can do so without power-consuming provisions for directing the fluid radially inward to a central suction port as would be required with a standard centrifugal pump. This feature results in increased pumping efficiency.

Having thus described the invention, I claim:

1. A fluid pump comprising:

a housing having at least one toroidal fluid passage, between at least two axially opposed radially extending walls, extending circumferentially between at least one fluid inlet port and at least one fluid discharge port, said ports being separated by an interruption of said fluid passage located upstream of said at least one inlet and downstream of said at least one discharge;

at least one regenerative rotor disk, rotatably supported between said at least two radially extending walls within said housing, and having a plurality of radially oriented impeller vanes situated about the periphery thereof within said toroidal fluid passage, the disk also having a plurality of permanent magnets embedded therein in a circular locus about an axis of rotation of said disk, said magnets being sealed against pumped fluid;

means for rotatably supporting said rotor disk at least one set of motor windings encased in at least one of said radially extending walls of said housing axially adjacent the permanent magnets in said at least one regenerative rotor disk, said motor windings being also sealed against pumped fluid; and means for controlling a flow of electric current through said motor windings to act upon said permanent magnets, thereby to rotatably drive said rotor disk.

2. The fluid pump of claim 1, wherein said housing has a plurality of diametrically opposed fluid inlet ports and a plurality of diametrically opposed fluid discharge ports in fluid communication with the fluid passage about the vanes of said at least one rotor disk such that the rotor is radially hydrodynamically balanced.

3. The fluid pump of claim 1, wherein said at least one regenerative rotor disk comprises a single rotatable regenerative rotor disk supported between two of said axially opposed radially extending walls disposed at axial ends of said housing, each said radially extending wall encasing a set of motor windings such that the rotor disk is magnetically axially balanced.

4. The fluid pump of claim 1, further comprising:

at least one inner radially extending wall, each said inner wall being axially adjacent to and interposed between two of a plurality of regenerative rotor disks to define one pumping stage for each said rotor disk, each said inner wall having at least one fluid passage extending between at least one fluid inlet port and one fluid discharge port and at least one set of motor windings for rotatably driving said rotor disks.

5. The fluid pump of claim 4, further comprising:

a fluid conduit extending from the fluid discharge port of a first pumping stage to the fluid inlet port of a second pumping stage, and so on, such that each succeeding pumping stage defined by said plurality of rotor disks has a higher inlet and discharge pressure than that of the preceding pumping stare.

6. The fluid pump of claim 1, wherein the means for rotatable supporting said at least one regenerative rotor disk comprises at least one bearing recess in said at least one rotor disk, at least one stationary bearing projection protruding from each said radially extending wall, and product lubricated bearings on either one of said at least one bearing recess or said at least one stationary bearing projection.

7. The fluid pump of claim 1, wherein the means for rotatable supporting said at least one regenerative rotor disk comprises at least one bearing recess in said at least one rotor disk, at least one stationary bearing projection protruding from each said radially extending wall, and magnetic bearings on either one of said at least one bearing recess or said at least one stationary bearing projection.

8. The fluid pump of claim 1, wherein the means for rotatable supporting said rotor disk comprises a cylindrical shaft supported between said axially opposed radially extending walls.

9. The fluid pump of claim 8, wherein the ends of said cylindrical shaft are fixedly supported within said axially opposed radially extending walls and said at least one rotor is rotatably supported on said shaft on product lubricated bearings.

10. The fluid pump of claim 8, wherein the ends of said cylindrical shaft are fixedly supported within said axially opposed radially extending walls and said at least one rotor is rotatably supported on said shaft on magnetic bearings.

11. The fluid pump of claim 8, wherein said cylindrical shaft is rotatably supported in said radially extending walls in product lubricated bearings.

12. The fluid pump of claim 8, wherein said cylindrical shaft is rotatably supported in said radially extending walls in magnetic bearings.

13. The fluid pump of claim 7, further comprising:

mechanical stand-off bearings for supporting the rotor disk during start-up and transient operating conditions.

14. The fluid pump of claim 10, further comprising:

mechanical stand-off bearings for supporting the shaft during start-up and transient operating conditions.

15. A fluid pump comprising at least one stage, each said stage comprising:

a housing having two axial endwalls and a radial sidewall, an inlet port, a discharge port, and a circumferential groove providing a fluid passage extending from said inlet port to said discharge port, said groove being interrupted between a downstream side of said discharge port and an upstream side of said inlet port;

a shaft supported between the endwalls of said housing;

a rotatable regenerative rotor disk mounted on said shaft and having a plurality of substantially radially oriented impeller vanes situated about the periphery thereof and extending into said fluid passage groove, said rotor disk having a plurality of permanent magnets embedded in a circular locus about said shaft, said magnets being sealed from pumped fluid;

motor windings encased in each of said endwalls adjacent the permanent magnets of said rotor; and means for controlling a flow of electricity through said motor windings to rotatably drive said rotor disk.

16. The fluid pump of claim 15, further comprising:

product lubricated bearings for supporting said shaft in at least the endwalls of said housing.

17. The fluid pump of claim 15, further comprising:

magnetic bearings for supporting said shaft in at least the endwalls of said housing.

18. The fluid pump of claim 15, further comprising:

product lubricated bearings for supporting said regenerative rotor on said shaft.

19. The fluid pump of claim 15, further comprising:

magnetic bearings for supporting said regenerative rotor on said shaft.

20. The fluid pump of claim 15, further comprising:

a second fluid inlet port and a second fluid discharge port substantially diametrically opposite said fluid inlet port and said fluid discharge port, respectively, in said fluid passage groove, said second fluid inlet port and said second fluid outlet port also being separated by a second interruption in said fluid passage groove.

21. The fluid pump of claim 17, further comprising:

mechanical stand-off bearings for supporting the shaft during start-up and transient operating conditions.

22. The fluid pump of claim 9, further comprising:

mechanical stand-off bearings for supporting the regenerative rotor during start-up and transient operating conditions.

23. A fluid pump comprising:

a housing having two axially opposed endwalls, each said endwall having a circular recess bounded by a circumferentially extending fluid passage groove such that, when butted together, said recesses form a pumping chamber and said grooves form a fluid passage extending between at least one inlet port and one discharge port, said fluid passage having an interruption at an upstream edge of said inlet port and a downstream edge of said discharge port;

a circular regenerative rotor disk within the pumping chamber between said housing endwalls, said rotor disk having a plurality of substantially radially extending impeller vanes arrayed about its periphery, and a plurality of permanent magnets embedded in a circular locus about the center of said rotor disk, said magnets being sealed against contact with pumped fluid;

motor windings encased in each of said housing endwalls and sealed against contact with said pumped fluid for acting with said permanent magnets to rotatably drive said rotor disk;

means for providing electric power to said motor windings; and means for rotatably supporting said rotor disk in said housing.

24. The fluid pump of claim 23, wherein the means for rotatably supporting said rotor disk in said housing comprises conical bearings projecting axially from said housing endwalls into conical recesses in said rotor disk.

25. The fluid pump of claim 23, wherein the means for rotatably supporting said rotor disk in said housing comprises conical bearings on the ends of a shaft on which said rotor disk is mounted, said conical bearings engaging in conical recesses in said housing endwalls.

26. The fluid pump of claim 23, wherein the means for rotatably supporting said rotor disk in said housing comprises projections extending axially from one of said rotor disk or said housing walls, said projections featuring bearings for engaging in congruent recesses in the other of said housing walls or said rotor disk.

27. The fluid pump of claim 23, further comprising;

at least one housing inner wall having a circular recess and a circumferentially extending groove on each axial face, such that, when interposed between said endwalls, said at least one inner wall forms at least two pumping chambers surrounded by at least two fluid passages extending between at least two inlet ports and two outlet ports; and at least two circular regenerative rotor disks rotatably supported within said at least two pumping chambers.

28. The fluid pump of claim 27, further comprising;

at least one fluid conduit, external to the pumping chambers, extending between the discharge port of one pumping chamber and the inlet port of a second pumping chamber.

29. The fluid pump of claim 27, further comprising:

a fluid conduit for receiving pumped fluid from all discharge ports simultaneously for combining volumetric flow from all stages of said pump.

30. The fluid pump of claim 24, further comprising:

at least one housing inner wall having a circular recess and a circumferentially extending groove on each axial face, such that, when interposed between said endwalls, said at least one inner wall forms at least two pumping chambers surrounded by at least two fluid passages extending between at least two inlet ports and two discharge ports;

at least two circular regenerative rotor disks rotatably supported within said at least two pumping chambers;

means for separately receiving pumped fluid from each of said at least two discharge ports for either combining flows or for maintaining separation of said flows; and means for individually rotatably driving said regenerative rotor disks such that only those disks needed for the pumping requirements at any given time are driven.

* * * * *

UNITED STATES PATENT AND TRADEMARK OFFICE

CERTIFICATE OF CORRECTION

PATENT NO. : 6,280,157 B1
DATED : August 28, 2001
INVENTOR(S) : Paul Cooper

It is certified that error appears in the above-identified patent and that said Letters Patent is hereby corrected as shown below:

Column 1,
Lines 54-55, "one rotatable rotatable rotor disk" should be -- one regenerative rotor disk --;

Column 6,
Line 30, "rotor disk" should be -- rotor disk --;
Line 67, "pumping stare" should be -- pumping stage --;

Column 7,
Lines 2, 9 and 16, "rotatable supporting" should be -- rotatably supporting --.

Signed and Sealed this

Ninth Day of April, 2002

*Attest:*

*Attesting Officer*

JAMES E. ROGAN
*Director of the United States Patent and Trademark Office*